US007264282B2

(12) United States Patent
Lambertz et al.

(10) Patent No.: US 7,264,282 B2
(45) Date of Patent: Sep. 4, 2007

(54) METHOD AND DEVICE FOR KNOTTING THE END OF A THREAD TO A FLAT OBJECT

(75) Inventors: Stefan Lambertz, Hürth (DE); Manfred Hauers, Viersen (DE); Dieter Vits, Neuss (DE)

(73) Assignee: Teepack Spezialmaschinen GmbH & Co. KG (DE)

( * ) Notice: Subject to any disclaimer, the term of this patent is extended or adjusted under 35 U.S.C. 154(b) by 653 days.

(21) Appl. No.: 10/839,007

(22) Filed: May 5, 2004

(65) Prior Publication Data

US 2004/0222634 A1 Nov. 11, 2004

(30) Foreign Application Priority Data

May 10, 2003 (EP) ..... 03010544

(51) Int. Cl.
*B65H 69/04* (2006.01)

(52) U.S. Cl. ..... 289/1.5

(58) Field of Classification Search ..... 289/1.5, 289/2, 5, 11
See application file for complete search history.

(56) References Cited

U.S. PATENT DOCUMENTS

| | | | | |
|---|---|---|---|---|
| 2,114,304 A | | 4/1938 | Ingram | |
| 5,527,419 A | * | 6/1996 | Vernon et al. | 156/446 |
| 6,206,256 B1 | | 3/2001 | Marzocchi | |
| 6,499,273 B1 | | 12/2002 | Marzocchi | |

FOREIGN PATENT DOCUMENTS

| | | |
|---|---|---|
| DE | 102 26 383 | 12/2002 |
| EP | 0 691 268 A1 | 1/1996 |
| EP | 0 807 579 A1 | 11/1997 |

* cited by examiner

*Primary Examiner*—Shaun R. Hurley
(74) *Attorney, Agent, or Firm*—Cantor Colburn, LLP

(57) ABSTRACT

The invention relates to a method and a device for knotting the end of a thread to a flat object containing two spaced holes for the knot. The method provides the thread located in front of the holes is pulled to the other side of the object while forming loops, and in that the loop is rotated by at least 270°. Subsequently the end of the thread is pulled through this loop and the knot that is formed is tightened. The device provides three tools, specifically two bars and a gripper.

13 Claims, 2 Drawing Sheets

METHOD AND DEVICE FOR KNOTTING THE END OF A THREAD TO A FLAT OBJECT

The invention relates to a method and a device for knotting the end of a thread to a flat object, in particular an infusion bag for preparing beverages and/or a label, containing two spaced holes for the knot.

BACKGROUND OF INVENTION

A large number of methods and devices for knotting the end of a thread to a flat object are known. The methods, most of which employ needles, are so complicated that their operating speed is limited. The corresponding devices consist of a large number of parts with a complicated sequence of motions so that they require a relatively large technical expenditure, especially for control of the parts.

The knots that are created with the familiar methods and devices are formed between a hole and an edge of the flat object. The thread forming the knot thus runs in the fiber direction of the paper forming the flat object. If heavy stress is applied to the knot, it can cause the paper to tear, especially when a slot for clamping the thread is provided, which develops a notch effect.

BRIEF SUMMARY OF INVENTION

The invention provides a method and a device for knotting the end of a thread to a flat object while avoiding the aforementioned disadvantages, while using few parts of simple design that have a simple sequence of operations so that a firmer connection can be achieved at a higher operating speed.

The method of the invention provides that the thread located in front of the holes on the one side of the object is pulled through the holes to the other side of the object and in doing so forms two loops, and that subsequently the loop formed by the thread that passes through is rotated by at least 270° and the portion of the other loop adjacent to the first loop is pulled through the twisted loop, including the end of the thread, while loosening the loop containing the end of the thread. Subsequently the knot that is formed is tightened.

After grasping the thread located on the one side of the object with the method of the invention, the latter is pulled through the holes to the other side in the form of two loops. After twisting the one loop formed by the thread that passes through by at least 270°, the end of the thread is pulled through the twisted loop, and the knot formed this way is tightened. This results in a very simple method for knotting the end of a thread to a flat object. The knot running between the two holes hereby leads to a stress running transversely to the fiber direction being applied on the flat object. Since the holes are punched out, any notch effect is moreover eliminated, resulting in a firmer connection between the knot and the flat object.

In accordance with other features of the invention, the loop is twisted by 450° so that it leads to a reliable holding of the knot.

Pulling the end of the thread from the one hole to the other side of the object subsequent to forming the two loops so as to prevent interlocking of the end of the thread in the hole is furthermore suggested with the invention.

The device of the invention is characterized in that two bars that are arranged at right angles to the surface of the object and are movable back and forth in the holes are provided, each containing hook-like recesses that grasp the thread, whereby the bar grasping the end of the thread can be moved between a front end position in which it grasps the thread on the one side of the object and a rear end position located on the other side in which it holds the thread loosely in the recess, in that the other bar is provided on the end in front of the recess with a opening for a gripper that is movable transversely to the bars, whereby this bar can be moved between a front end position on the one side of the object grasping with the recess and a second position enabling passage of the gripper, and can be rotated in the second position by at least 270°.

In accordance with another feature of the invention the other bar, can be moved into a rear end position that is retracted from the travel range of the gripper.

The device of the invention requires only three movable parts. The two bars located parallel to and at a distance from each other and the gripper running at a right angle to them are moved back and forth. The one bar containing only the hook-like recess is moved only between a front end position located on the one side of the object and a rear end position located on the other side. The other bar equipped additionally with the opening for the gripper assumes between its front end position located on one side of the flat object and its rear end position that is retracted from the travel range of the gripper a second position in which it rotates the loop by rotating at least 270° and in this way closes it. In this position, the gripper travels through the opening of the bar and hence through the twisted loop. It grasps the end of the thread and pulls it through the twisted loop before the second bar is pulled into the rear end position and hence out of the travel range of the gripper.

Using only three movable parts and their simple control into just a few end or intermediate positions results in a simple design of the device and enables a high operating speed.

In a preferred embodiment of the invention, the rotable bar is rotated by 450° to achieve a secure holding of the knot.

In accordance with another feature of the invention, the opening of the rotable bar is designed as a slot opening into the end face. Carrier noses are formed in accordance with the invention for the thread running in a loop on the end faces of the fork arms forming the slot. In accordance with another feature of the invention, these carrier noses are formed by projections, which each extend between the end face arranged approximately at a right angle to the pin's longitudinal axis and an inclined surface constructed on a portion of the same. The inclined surfaces are hereby diagonally offset on the end faces.

In a preferred embodiment of the device of the invention, the opening or the slot is arranged at a right angle to the hook-like recess so that the end position of the bar upon its rotation is always offset in relation to the original position at a right angle.

The gripper of the invention is equipped with a clamping jaw and a locking jaw that performs an opening or closing motion to enable secure grasping of the end of the thread. In a preferred embodiment, the gripper consists of a flat bar with a clamping jaw arranged at the end and a slide that can be moved relative to the flat bar, the end face of which interacts with the clamping jaw as the locking jaw.

BRIEF DESCRIPTION OF THE DRAWINGS

Further advantages and features of the invention result from the following description of one embodiment, wherein the drawing illustrates.

DETAILED DESCRIPTION OF INVENTION

Figure 1:
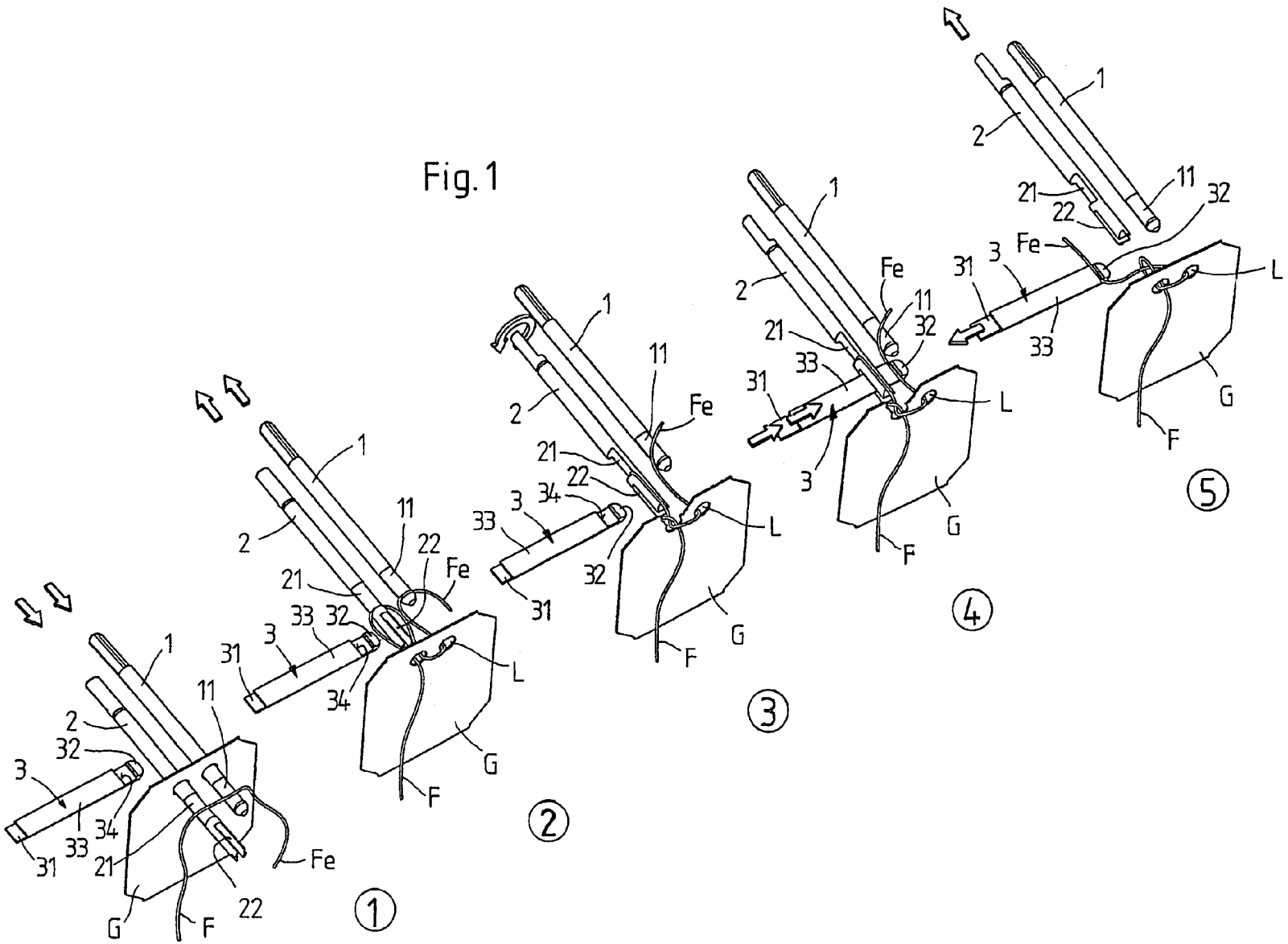
FIG. 1 a diagrammatic perspective depiction of the three tools during formation of the knot in five steps, and FIG. 2 a side view, top view, perspective depiction and detailed view of the rotable bar.
Figure 2:
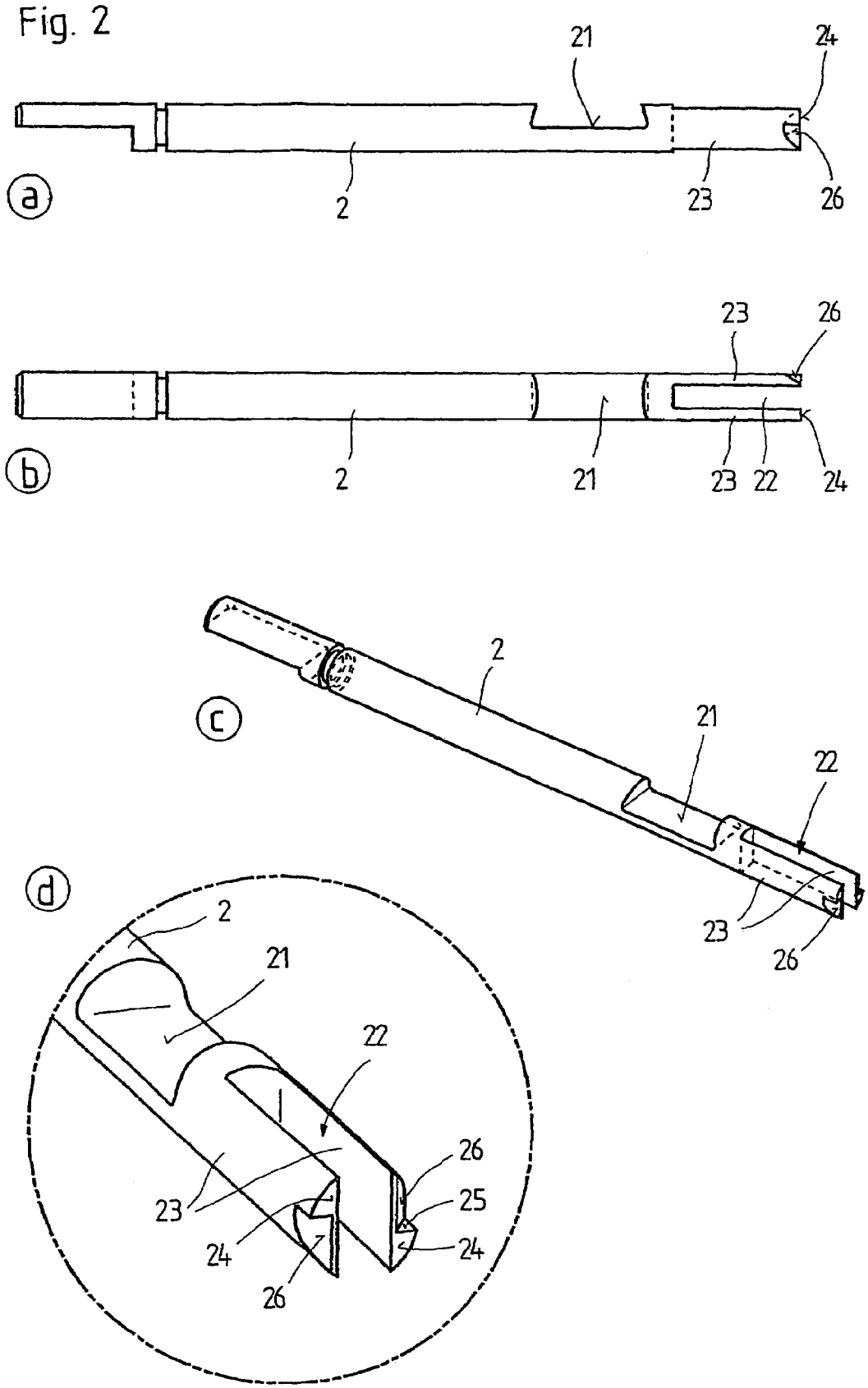

The device for knotting the end of a thread F to a flat object G, which is depicted in form of a label in FIG. 1, comprises three tools, specifically a first bar 1, a second bar 2 and a gripper 3. These three tools are depicted in five different positions in FIG. 1 in diagrammatic and perspective views. FIG. 2 shows bar 2 in a side view (a), a top view (b), a perspective depiction (c) and a detailed view (d) with respect to its end face construction.

As FIG. 1 shows, the bars 1 and 2 extend parallel to and at a distance from each other. The gripper 3 is mobile at a right angle to them in the plane in which the bars 1 and 2 are located.

As FIG. 1 reveals, the bar 1 is mobile between a front end position (see FIG. 1.1) and a rear end position (see FIG. 1.2 to 1.5). It is equipped with a hook-like recess 11 on its front end, which serves to accommodate the thread F.

The second bar 2 also comprises a recess 21 of this type which forms a hook, which nonetheless is equipped on its front end with a opening for the gripper 3, which is designed as a slot 22.

FIG. 2 clearly shows this slot 22. It shows that it is formed by two fork arms 23, the end faces 24 of which respectively contain a carrier nose 25. For this purpose (see FIG. 2*d*) a portion of the end face 24 is formed as an inclined surface, creating the carrier nose 25. The inclined surfaces 26 are arranged 180° offset from each other in relation to the needle longitudinal axis and thus offset on the end faces 24 so that the carrier noses 25 pick up the thread F formed into a loop (see FIG. 1.3 and FIG. 1.4) when rotating the bar 2.

In particular, FIG. 2*a* shows furthermore that the recess 21 is designed in the form of an undercut groove, thus creating hooks at its ends. The recess 11 of the bar 1 is correspondingly designed.

The gripper 3 in the embodiment consists of a flat bar 31, which is provided on the front end as a single piece with a clamping jaw 32 for the thread F. A slide 33 is arranged movably on the flat bar 31, the end face of which serves as the locking jaw 34, into which the thread F engages when the slide 33 has been slid into its front position relative to the flat bar (see FIG. 1.4 and 1.5).

The method for forming the knot will now be explained with reference to FIG. 1:

The label G, which runs at a right angle to the travel direction of the bars 1 and 2, is provided with holes L through which the bars 1 and 2 extend. As a first step (FIG. 1.1) the bars 1 and 2 are brought through the holes L into their front end positions in which the recesses 11 and 21 are located adjacent to each other. The thread F is now placed into the recesses 11 and 21, wherein the end Fe of the thread protrudes slightly beyond the bar 1.

Now both bars 1 and 2 are pulled out of the holes L by the same amount in accordance with FIG. 1.2. The hook-like recesses 11 and 21 hereby pick up the thread F, so that two loops result. Subsequently the loop located on the bar 2 is rotated preferably by 450°, for which purpose the bar 2 is driven and rotated as indicated by the arched arrow in FIG. 1.3. The loop is hereby reliably closed by twisting the thread F.

Now the gripper 3 travels through the slot 22 of the bar 2, as shown in FIG. 1.4, and hence through the loop, and grasps the portion of the thread F located adjacent to the twisted loop on the bar 1. By means of a relative motion between the slide 33 and the flat bar 31, the gripper 3 grasps the end Fe of the thread by clamping the thread F between the clamping jaw 32 and the locking jaw 34, as is likewise shown in FIG. 1.4.

Subsequently the gripper 3 is retracted according to FIG. 1.5, after having previously transferred the bar 2 into the rear end position. The knot that is formed is now tightened. The label G is reliably attached to the end of the thread F. The gripper 3 opens up and upon removal of the label G, the bars 1 and 2 return to the original position indicated in FIG. 1.1.

The thread F extending between the two holes L forms a knot, the thread course of which is transverse to the fiber direction of the label G so that the stress of the peg located between the holes is absorbed without the risk of ruptures, even when tightening the knot. Since the two holes L are punched with exact contours, any notch effect is eliminated. The design results in a reliable, firm connection between the knot and the label G.

The invention claimed is:

1. Method for knotting an end of a thread to a flat object containing two spaced holes for the knot comprising:

pulling the thread located in front of the holes on one side of the object through the holes to the other side of the object to form first and second loops subsequently rotating the first loop formed by the thread that passes through by at least 270° and pulling a portion of the second loop adjacent to the first loop through the twisted first loop including an end of the thread while loosening the loop holding the end of the thread, and subsequently the knot formed is tightened.

2. Method according to claim 1, wherein the first loop is rotated by 450°.

3. Method according to claim 1 wherein the end of the thread is pulled out of a hole to the other side of the object subsequent to forming the two loops.

4. Device for knotting the end of a thread to a flat object containing two spaced holes for the knot comprising:

two bars that are movable back and forth at a right angle to a surface of the object through the holes are provided, which both comprise a hook-like recess for grasping the thread, wherein one of the bars grasping an end of the thread can be moved between a front end position grasping the thread on one side of the object and a rear end position lying on the other side loosely holding the thread in the recess, wherein the other bar is equipped at an end with an opening in front of the recess for a gripper mobile transversely in relation to the bars, whereby this other bar is movable between a front end position on one side of the object grasping the thread with a recess and a second position located on the other side of the object enabling passage of the gripper, and can be rotated in the second position by at least 270°.

5. Device according to claim 4, wherein the other bar can be moved into a rear end position that is retracted from a travel range of the gripper.

6. Device according to claim 4, wherein the other bar can be rotated by 450°.

7. Device according to claim 4, wherein the opening of the rotating other bar is designed as a slot joining into an end face.

8. Device according to claim 7, on end faces of fork arms forming the slot, carrier noses are provided for the thread running in a loop.

9. Device according to claim 8, wherein the carrier noses are formed by projections, which each run between an end face located at roughly a right angle to the other bar's longitudinal axis and an inclined surface formed on a portion of the same.

10. Device according to claim 9, wherein the inclined surfaces are formed diagonally offset on the end faces.

11. Device according to claims 7, wherein or the slot is arranged at a right angle to the recess.

12. Device according to at least one of the claims, wherein the gripper comprises a clamping jaw and a locking jaw performing an opening or closing motion.

13. Device according to claim 12, wherein the gripper comprises of a flat bar with the clamping jaw formed on an end and a slide movable relative to the flat bar an end face of which interacts with the clamping jaw as the locking jaw.

* * * * *